US011341819B2

(12) United States Patent
Breslo et al.

(10) Patent No.: US 11,341,819 B2
(45) **Date of Patent: *May 24, 2022**

(54) PROGRESSIVE JACKPOT FOR DEALS OF INSTANT GAME TICKET WHERE WINNING PROGRESSIVE JACKPOT INSTANT TICKET IS RANDOMLY SELECTED FROM UNPLAYED TICKETS AFTER PROGRESSIVE JACKPOT AMOUNT FOR THE DEALS OF INSTANT TICKETS REACHES PREDETERMINED VALUE

(71) Applicant: Diamond Game Enterprises, Chatsworth, CA (US)

(72) Inventors: William F. Breslo, Santa Monica, CA (US); Bryan J. Greene, Culver City, CA (US); Atena Reyhani, Woodland Hils, CA (US)

(73) Assignee: DIAMOND GAME ENTERPRISES, Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/234,217

(22) Filed: Apr. 19, 2021

(65) Prior Publication Data

US 2021/0241569 A1 Aug. 5, 2021

Related U.S. Application Data

(62) Division of application No. 16/164,186, filed on Oct. 18, 2018, now Pat. No. 10,984,635.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.
CPC ..... *G07F 17/329* (2013.01); *G07F 17/3225* (2013.01); *G07F 17/3258* (2013.01)

(58) Field of Classification Search
CPC ..... G07F 17/3258; G07F 17/329
See application file for complete search history.

(56) References Cited

U.S. PATENT DOCUMENTS 5,280,909 A 1/1994 Tracy
5,617,592 A 4/1997 Cheng
(Continued)

OTHER PUBLICATIONS

Michael Shackleford, "Mystery Progressives." Downloaded from web page: https://wizardofodds.com/games/slots/mystery-jackpot/ Download date: Sep. 25, 2018, Last Updated: Aug. 19, 2016, original posting date: unknown, Copyright © 1998-2018 Wizard of Odds Consulting, Inc., 7 pages.
(Continued)

*Primary Examiner* — Milap Shah
(74) *Attorney, Agent, or Firm* — Panitch Schwarze Belisario & Nadel LLP

(57) ABSTRACT

A winning progressive jackpot ticket is selected from deals of instant tickets that are dispensed from a network of gaming machines by randomly selecting, upon initiation of a progressive jackpot, a progressive jackpot value that falls within a predetermined range of progressive jackpot values, detecting in the server when the progressive jackpot value is reached as a result of a purchase of an instant ticket at one of the gaming machines, randomly selecting the winning progressive jackpot ticket from all of the currently unplayed instant tickets, or from the next n number of currently unplayed instant tickets, when the progressive jackpot value is detected as reaching the progressive jackpot value that was randomly selected, and awarding the current progressive jackpot amount to the player who subsequently purchases the winning progressive jackpot ticket.

14 Claims, 4 Drawing Sheets

(56) References Cited

U.S. PATENT DOCUMENTS

| | | | | |
|---|---|---|---|---|
| 5,944,606 | A | 8/1999 | Gerow | |
| 6,210,276 | B1 | 4/2001 | Mullins | |
| 6,309,298 | B1 | 10/2001 | Gerow | |
| 7,695,360 | B2 | 4/2010 | Breslo | |
| 9,251,663 | B1 | 2/2016 | Sandvick | |
| 9,443,397 | B1 | 9/2016 | Sandvick | |
| 10,062,240 | B2 | 8/2018 | Breslo et al. | |
| 10,984,635 | B2 * | 4/2021 | Breslo | G07F 17/329 |
| 2003/0030211 | A1 | 2/2003 | Brown | |
| 2005/0176490 | A1 | 8/2005 | Wright | |
| 2010/0203958 | A1 | 8/2010 | Jackson | |
| 2012/0122536 | A1 | 5/2012 | Frick et al. | |
| 2016/0275754 | A1 * | 9/2016 | Hanus | G07F 17/329 |
| 2017/0053495 | A1 | 2/2017 | Breslo et al. | |
| 2017/0228966 | A1 | 8/2017 | Irwin, Jr. | |

OTHER PUBLICATIONS

LT-3 instant ticket vending machine ("ITVM"), Diamond Game Enterprises, downloaded from Diamond Game lottery products web pages, download date: Sep. 25, 2018, original posting date: unknown, 7 pages.

* cited by examiner

TICKET 1 (FRONT)

692 1A2 95D 000621 19037 70904311A0918

TICKET 1 (BACK)

000621 19037 000002

TICKET 2 (FRONT)

459 23C 62B 000621 19032 70904311A0918

TICKET 2 (BACK)

000621 19032 000002

FIGURE 2

(PRIOR ART)

PROGRESSIVE JACKPOT FOR DEALS OF INSTANT GAME TICKET WHERE WINNING PROGRESSIVE JACKPOT INSTANT TICKET IS RANDOMLY SELECTED FROM UNPLAYED TICKETS AFTER PROGRESSIVE JACKPOT AMOUNT FOR THE DEALS OF INSTANT TICKETS REACHES PREDETERMINED VALUE

CROSS-REFERENCE TO RELATED APPLICATIONS

This application is a divisional of copending U.S. application Ser. No. 16/164,186 filed Oct. 18, 2018, which is incorporated by reference herein.

BACKGROUND OF THE INVENTION

Instant games are games wherein the outcome of the game play (win or lose) is immediately available to the player. One example of an instant game is a scratch-off lottery ticket. Another example is an instant game (pull tab game) described in U.S. Pat. No. 7,695,360 (Breslo), and commercialized as Lucky Tab®, by Diamond Game Enterprises, Chatsworth, Calif., the disclosure of which is incorporated by reference herein.

A progressive jackpot is a jackpot which increases each time the game is played but the jackpot is not won. The progressive jackpot is typically funded by allocating a small percentage of the purchase price of each game play to the jackpot. Progressive jackpots are common in the slot machine industry. However, the slot machine industry does not rely upon pre-printed tickets or their electronic equivalent, where the outcome of the game play is predetermined.

A "mystery progressive" or "mystery jackpot" is a specific methodology for managing a progressive jackpot. The principle advantage of a mystery progressive for a game operator is that it runs independently of the different math models and game themes provided from the various slot machine vendors. (A traditional, non-mystery progressive is controlled by the vendor and can operate only on that vendor's machines and typically only on one math model of that vendor.) A mystery progressive typically operates as follows (this example presumes that there is a network of slot machines that all participate in the same mystery progressive):

1. The jackpot starts at a defined minimum amount.
2. The game operator selects a range of coin-in values where the jackpot may be won (e.g., coin-in across the network of slot machines must be between $5,000,000 and $15,000,00, wherein coin-in is the accumulated monetary amount of funds played on the slot machines in the network).
3. A random number generator (RNG) selects a specific coin-in value within the range as being the jackpot win trigger.
4. As game play continues, the jackpot is incremented as described above (typically, by using a predetermined percentage of the coin-in).
5. When the coin-in value crosses the exact jackpot win trigger, the player whose slot machine crossed the exact jackpot win trigger is awarded the jackpot.
6. The jackpot is then reset and this process is repeated.

In an alternative embodiment that is described in the background section of U.S. Pat. No. 5,280,909 (Tracy), the game operator selects a range of jackpot values (not coin-in values) where the jackpot can be won, and then the RNG selects a specific jackpot value within the range as being the jackpot win trigger. When the jackpot value crosses the jackpot win trigger as a result of coin-in activity, the player whose slot machine's coin-in activity caused the jackpot win trigger to be crossed is awarded the jackpot.

The odds of winning the jackpot increase from zero to a non-zero value whenever the coin-in value or jackpot value is within the range. Furthermore, the odds of winning the jackpot increase even further as the coin-in value or jackpot value progresses through the range and no jackpot winner is selected. The exact coin-in or jackpot win trigger and the lower limit of the range are both kept in the highest level of secrecy. However, mystery jackpots advertise a "Win Before" value (i.e., the upper limit of the range) to encourage play as the accumulated amount reaches this value.

To enhance the value and excitement of game play, progressive jackpots have been selectively introduced into the instant game industry, which also includes networks of gaming machines (e.g., ticket dispensers) for purchasing and playing instant game tickets. However, the following challenges arise when attempting to implement a progressive jackpot in the instant game field:

1. How to operate a mystery progressive with a finite ticket game in which the ticket must determine the outcome of the game, including the progressive. In other words, coin-in cannot be used to determine the progressive winner, since the ticket must determine the winner.
2. How to operate a wide-area progressive across multiple finite ticket games with varying math models.
3. How to securely provide a large-value progressive jackpot, e.g. six+ figures, with a pre-printed ticket game. (With a single large pre-printed jackpot ticket, there is greater incentive among press personnel to act nefariously to identify the whereabouts of such a ticket and exploit that knowledge, thus compromising the integrity of the game.)

The present invention addresses these challenges by providing an inventive methodology for playing a mystery progressive with instant tickets.

SUMMARY OF THE PRESENT INVENTION

A winning progressive jackpot ticket is selected from a deal of instant tickets that are dispensed from a network of gaming machines by randomly selecting, upon initiation of a progressive jackpot, a coin-in value that falls within a predetermined range of coin-in values, detecting in the server when the coin-in value is reached as a result of a purchase of an instant ticket at one of the gaming machines, randomly selecting the winning progressive jackpot ticket from all of the currently unplayed instant tickets, or from the next n number of currently unplayed instant tickets, when the coin-in value is detected as reaching the coin-in value that was randomly selected, and awarding the current progressive jackpot amount to the player who subsequently purchases the winning progressive jackpot ticket. A similar process randomly selects a progressive jackpot value that falls within a predetermined range of progressive jackpot values.

BRIEF DESCRIPTION OF THE DRAWINGS

Preferred embodiments of the present invention will now be described by way of example with reference to the accompanying drawings:

FIG. 2 shows sample tickets produced using one preferred embodiment of the system of FIG. 1.

DETAILED DESCRIPTION OF THE INVENTION

Figure 1:
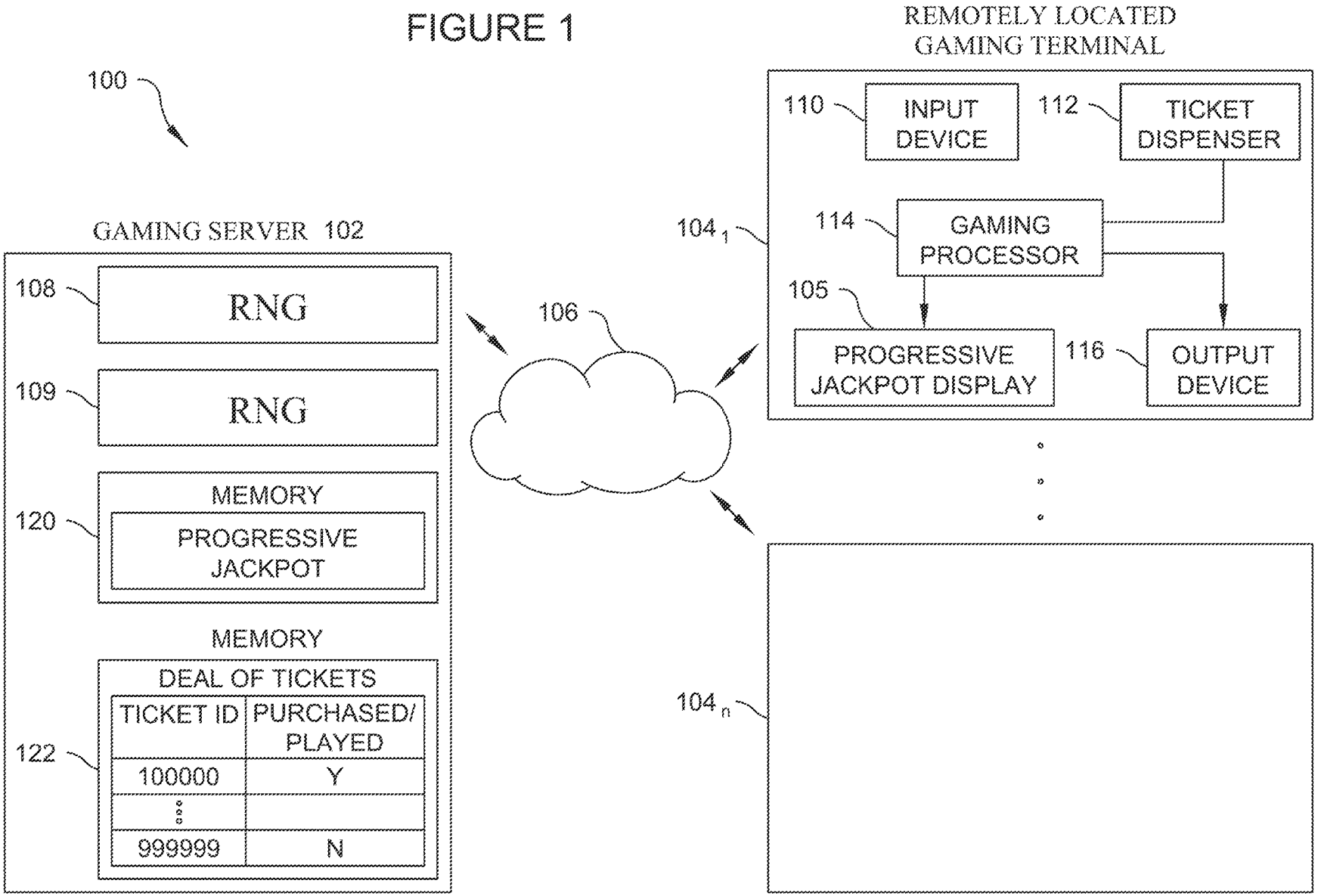
FIG. 1 is a schematic diagram of a system for implementing preferred embodiments of the present invention.

Certain terminology is used herein for convenience only and is not to be taken as a limitation on the present invention.

The words "a" and "an", as used in the claims and in the corresponding portions of the specification, mean "at least one."

I. Definitions

The following definitions are provided to promote understanding of the present invention.

unplayed ticket/played ticket and unpurchased ticket/purchased ticket—An unplayed ticket is a ticket that has not yet been purchased, whereas a played ticket is a ticket that has been purchased. In one embodiment of the present invention, pre-printed tickets are dispensed from a gaming machine after being purchased, as described in U.S. Pat. No. 7,695,360. During the dispensing process, machine readable indicia on the ticket is read by a scanner inside of the gaming machine, and the results of the ticket are immediately shown on a display of the gaming machine. Accordingly, the tickets are simultaneously purchased and played, and thus these terms are used interchangeably herein.

In other embodiments which use physical pre-printed tickets, a ticket may be purchased, but the result of the game play may not be readily apparent to the player until the player takes some type of action, such as by removing a Scratch-Off Coating (SOC), or by scanning the ticket at a ticket checker that is separate from the ticket dispensing device. In these embodiments, the ticket will still be presumed to be "played" as a result of being purchased. Accordingly, as described herein, each instant ticket has one of two states, namely, purchased/played or unpurchased/unplayed.

In embodiments wherein the tickets only exist in electronic form, purchasing and playing also occurs simultaneously.

deal—To create instant tickets, a "deal" of game results is created using a computer program and the instant tickets are subsequently printed or electronically created to match the deal, or a portion thereof. There are a fixed amount of predetermined wins in each deal. The type and amount of wins in the deal or deal portion are used to create the content of the tickets. As used herein, a "deal" may be a single deal, or may be a plurality of deals. For simplicity, both scenarios are referred to as a "deal."

progressive jackpot—The concept of a progressive jackpot is described above in the background section. The progressive jackpot of the present invention is presumed to be funded by a predefined portion of the coin-in value.

coin-in—As used herein, coin-in is the accumulated monetary cost of purchased instant tickets from the deal across the network of gaming machines. Thus, the coin-in represents the accumulated monetary value played on the gaming machines. Furthermore, as used herein, coin-in refers only to payment activity that is linked to funding a progressive jackpot. Coin-in may be represented as a dollar value or as a credit. For example, if a total monetary value of a deal is $20,000,000 and a game (e.g., one ticket) is $1.00, the total coin-in of the deal is $20,000,000. However, if a game is one cent, the coin-in for the deal may be represented as 2,000,000,000 credits. This type of flexibility may be used in the multi-bet environment described in U.S. Pat. No. 7,695,360.

II. Detailed Description

FIG. 1 shows a gaming system 100 for implementing one preferred embodiment of the present invention. The gaming system 100 includes gaming server 102, a plurality of remotely located gaming terminals $\mathbf{104}_1$ to $\mathbf{104}_n$, hereafter individually referred to as "gaming terminal 104," and an electronic network 106 (e.g., Internet, LAN) for connecting gaming terminal 104 with the gaming server 102. The gaming terminal 104 is also interchangeably referred to herein as a "gaming machine."

Each gaming terminal 104 includes a local gaming processor 114 configured to receive data from an input device 110 (user interface for the player), perform any necessary communications with the gaming server 102, and control a ticket dispenser 112 and an output device 116, such as a display that shows the game results.

The gaming server 102 is configured to administer a plurality of instant games having a progressive jackpot. The remotely located gaming terminal 104 may include a progressive jackpot display 105. If there are a plurality of gaming terminals 104 in a common area, the progressive jackpot display 105 may be separately mounted on a wall of the common area. One example of a suitable gaming terminal 104 that dispenses purchased instant tickets is shown in U.S. Pat. No. 7,695,360, with the addition of the progressive jackpot display 105. Another example of a suitable gaming terminal 104 is the LT-3 instant ticket vending machine ("ITVM"), commercially available from Diamond Game Enterprises.

To facilitate the progressive jackpot feature, the gaming server 102 includes a first RNG 108 and a second RNG 109. In one configuration, the RNG 108 and RNG 109 are separate RNG's, whereas in another configuration, the RNG 108 and RNG 109 are the same RNG. The respective functions of the RNG's are described below. The gaming server 102 also includes a first memory 120 for maintaining the value of the successively incrementing progressive jackpot. The gaming server 102 further includes a second memory 122 that maintains a purchase/play status for deals of tickets (i.e., ticket was purchased/played=YES or NO).

One preferred embodiment of the present invention provides an automated method for selecting a winning progressive jackpot ticket from a deal of instant tickets that are played across a network of gaming terminals 104 that dispense purchased instant tickets. The network of gaming terminals 104 is connected to the gaming server 102. The gaming server 102 tracks (i) a coin-in value representing the accumulated monetary cost of purchased instant tickets from the deal across the network of gaming terminals 104, and (ii) played and unplayed instant tickets. Each of the instant tickets has a unique identification number. An example of an instant ticket from a deal of instant tickets is shown in FIG. 2, which is reproduced from FIG. 1 of U.S. Pat. No. 7,695,360. The ticket includes a unique identification number in human-readable and machine readable format, as well as deal identifying information. Other examples of instant tickets that are suitable for use with the present invention include scratch-off lottery tickets.

Figure 3:
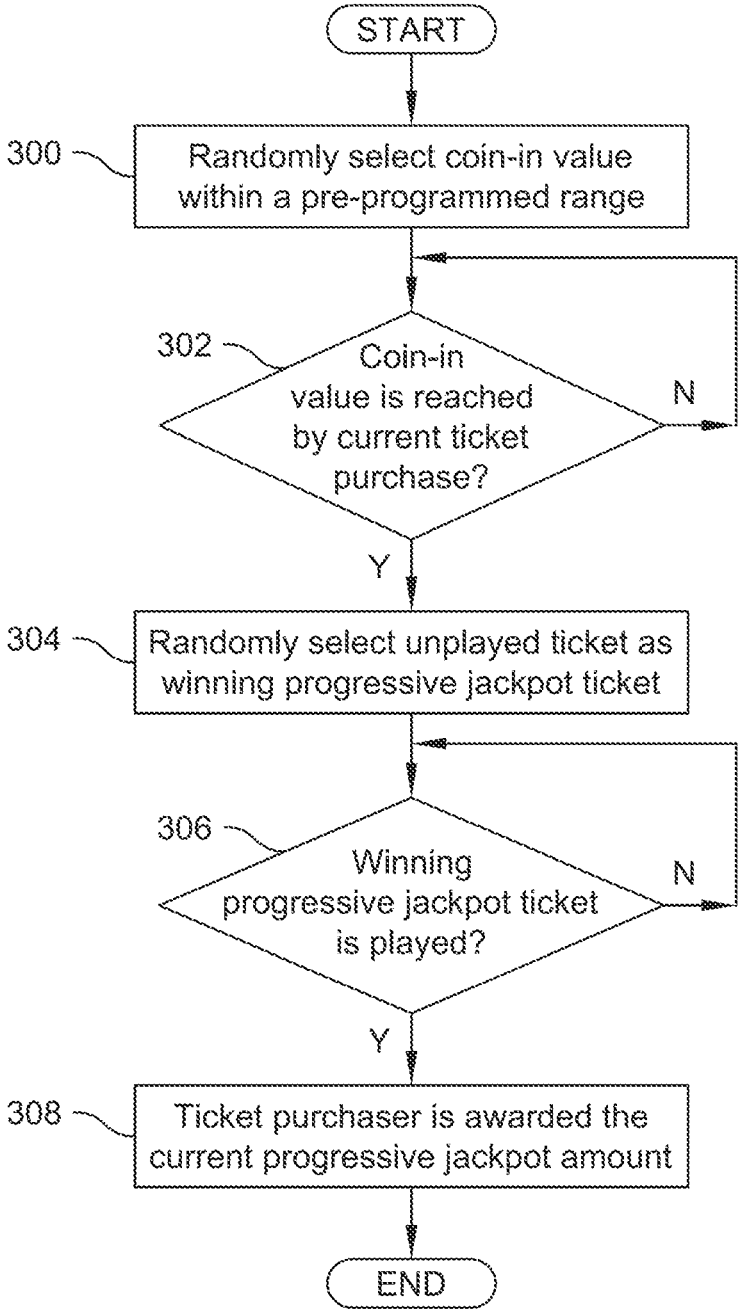
FIGS. 3 and 4 show flowcharts in accordance with preferred embodiments of the present invention.

Referring to FIG. 3, one preferred embodiment operates as follows:

STEP 300: Upon initiation of a progressive jackpot, randomly select, using the RNG 108, a coin-in value that falls within a predetermined range of coin-in values. For example, if the coin-in value is expected to reach $20,000,000 in the next month based on current game play statistics for the network of gaming terminals 104, a predetermined range may be set, such as $5,000,000 to $13,000,000, and the RNG 108 then randomly selects a coin-in value within that range, such as $10,352,765.

STEP 302: The gaming server 102 detects when the coin-in value is reached (crossed) as a result of a purchase of an instant ticket at one of the gaming terminals 104.

STEP 304: The second RNG 109 randomly selects the winning progressive jackpot ticket from all of the currently unplayed instant tickets, or from the next n number of currently unplayed instant tickets, when the coin-in value is detected as reaching the coin-in value that was randomly selected in step 300. In the example above, when the coin-in value of the gaming terminals 104 in the network crosses $10,352,765 as a result of a ticket purchase at one of the gaming terminals, the second RNG 109 randomly selects the winning progressive jackpot ticket from all of the currently unplayed instant tickets, or from the next n number of currently unplayed instant tickets, as indicated in the memory 122. Unlike the prior art described above, the player who is responsible for crossing the coin-in value does not win the progressive jackpot. Nor is the player informed that the coin-in value has been crossed. No public display provides this information either. Accordingly, players will have no basis to perceive that their chances of winning a progressive jackpot have increased at any particular point in time.

Consider an example of a deal of 20,000,000 tickets which are expected to be played in the next month, each having a $1.00 purchase price ($1.00 denomination/1 bet), thereby providing a total coin-in value of $20,000,000. When the ticket is purchased that results in the coin-in value crossing $10,352,765, which is about half of the tickets in the deal, ticket number 14,954,333 is selected by the RNG 109 as the progressive jackpot ticket.

STEPS 306 and 308: The gaming server 102 awards the current progressive jackpot amount to the player who subsequently purchases the winning progressive jackpot ticket, which would be ticket number 14,954,333 in the example described above. The player is also awarded any winning amounts associated with the non-jackpot game play of the winning progressive jackpot ticket. Since the winning progressive jackpot ticket was not known at the time of generation of the tickets (whether they were physically printed or only electronically stored), it is entirely possible for the winning progressive jackpot ticket to also be a non-jackpot winner.

Figure 4:
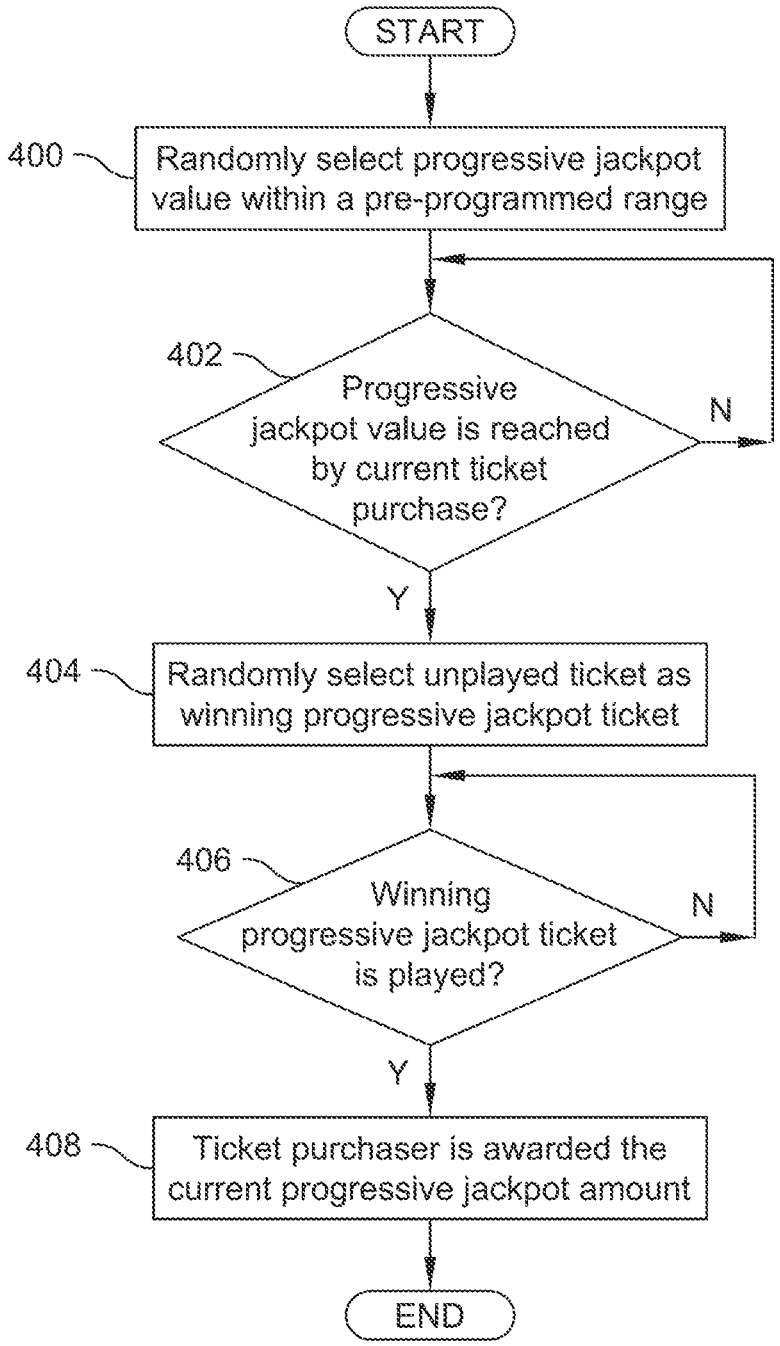

FIG. 4 shows another preferred embodiment that is similar in concept to the FIG. 3 embodiment, except that the selection of the unplayed ticket that is to become the winning progressive jackpot ticket is made based on the progressive jackpot reaching (crossing) a randomly selected value that is within a predetermined range.

STEP 400: Upon initiation of a progressive jackpot, randomly select, using the RNG 108, a progressive jackpot value that falls within a predetermined range of progressive jackpot values. The lower value in the range should be a non-zero value, and the higher value in the range should be no greater than the maximum possible jackpot value set by the gaming operator. A predetermined range may be set, such as $5,000 to $13,000, and the RNG 108 then randomly selects a jackpot value within that range, such as $10,352.

STEP 402: The gaming server 102 detects when the progressive jackpot value is reached (crossed) as a result of a purchase of an instant ticket at one of the gaming terminals 104.

STEP 404: The second RNG 109 randomly selects the winning progressive jackpot ticket from all of the currently unplayed instant tickets, or from the next n number of currently unplayed instant tickets, when the jackpot value is detected as reaching the jackpot value that was randomly selected in step 300. In the example above, when the jackpot value of the gaming terminals 104 in the network crosses $10,352 as a result of a ticket purchase at one of the gaming terminals, the second RNG 109 randomly selects the winning progressive jackpot ticket from all of the currently unplayed instant tickets, or from the next n number of currently unplayed instant tickets, as indicated in the memory 122. The player who is responsible for crossing the jackpot value does not win the progressive jackpot. Nor is the player informed that the jackpot value has been crossed. No public display provides this information either. Accordingly, players will have no basis to perceive that their chances of winning a progressive jackpot have increased at any particular point in time.

Consider again an example of a deal of 20,000,000 tickets which are expected to be played in the next month, each having a $1.00 purchase price, thereby providing a total maximum jackpot value of $20,000, assuming the 1% contribution. When the ticket is purchased that results in the jackpot value crossing $10,352, which is about half of the tickets in the deal, ticket number 14,954,333 is selected by the RNG 109 as the progressive jackpot ticket.

STEPS 406 and 408: The gaming server 102 awards the current progressive jackpot amount to the player who subsequently purchases the winning progressive jackpot ticket, which would be ticket number 14,954,333 in the example described above. The player is also awarded any winning amounts associated with the non-jackpot game play of the winning progressive jackpot ticket. Since the winning progressive jackpot ticket was not known at the time of generation of the tickets (whether they were physically printed or only electronically stored), it is entirely possible for the winning progressive jackpot ticket to also be a non-jackpot winner.

The preferred embodiments of the present invention address each of the challenges highlighted above that arise when attempting to implement a progressive jackpot in the instant game field. By determining the winning ticket outside of the printing factory, there is no way collusion or insider knowledge gleaned during the ticket printing or distribution process can impact the integrity of the game. Furthermore, the contributions to the progressive jackpot occur across all machines, game themes, and math models, tracked by the gaming server 102, and do not impact in any way the existing math models of the various games in play.

III. Additional Considerations

A. Pre-Printed Physical Tickets Vs. Electronic Tickets

As is well-known in the art, instant tickets may be either pre-printed physical tickets or electronic-only tickets. Pre-printed physical tickets are physically distributed to the respective retail outlets, such as by being loaded into a network of gaming terminals 104. Electronic tickets are electronically dispensed in ordered sequence from the gaming server 102 as tickets are purchased at the respective gaming terminals 104. In both instances, the status of the ticket (e.g., purchased (played)/not purchased (not played))

is recorded in the second memory 122. In the case of electronic tickets, the gaming terminal 104 may include a printer for printing out a receipt of the purchased/played ticket if required by the jurisdiction and/or if requested by the player.

B. Multiple Jackpots Per Deal

There may be multiple jackpots per deal so as to further reduce any perceptions (whether real or imagined) that any particular time to play results in better or worse odds of winning a progressive jackpot. In this manner, the progressive jackpot may be reset multiple times during game play of a deal of tickets. Consider the example above wherein ticket number 14,954,333 is selected as the progressive jackpot ticket. After this ticket is played, and the jackpot is reset, the process may be repeated for the remaining unplayed tickets as follows:

1. A second coin-in value is randomly selected within a pre-programmed range. For example, if there are $3,000,000 worth of unplayed tickets remaining in the deal, the new range may be $18,000,000 to $18,500,000, and the RNG 108 selects a second coin-in value within that range, such as $18,201,354.

2. When the coin-in value reaches this value (i.e., $18,201,354), the RNG 109 selects a second unplayed ticket in the deal to be another progressive jackpot ticket, such as ticket number 19,345,778. When this ticket is purchased, the player who purchased the ticket wins the current jackpot amount.

In an embodiment wherein the deal of tickets are physical tickets loaded into a plurality of gaming terminals 104, there will be some uncertainty regarding the timing of when an additional jackpot is created. This is because the timing of when the initially selected winning progressive jackpot ticket is played depends upon how much play activity is occurring at the gaming machine 104 that contains the winning progressive jackpot ticket. This uncertainly will be significantly reduced in an embodiment wherein the tickets are represented only in electronic form because the gaming server 102 will control the next ticket number to be played, regardless of the gaming machine 104 that the player has selected, and thus the timing between when the winning progressive jackpot ticket number is selected and when it is purchased is more predictable, and depends only on the overall rate of ticket purchasing in the network of gaming machines 104.

In the multiple jackpot per deal embodiment, the flowchart of FIG. 3 repeats after the current progressive jackpot is awarded. Furthermore, when there are multiple jackpots per deal, the winning progressive jackpot ticket is not randomly selected from all of the currently unplayed instant tickets, but instead is selected from the next n number of currently unplayed instant tickets.

C. Seeded Progressive Jackpot

As is well-known in the art, the progressive jackpot may be seeded with a significant value so as to avoid deterring game play when the progressive jackpot is small.

D. Clerk-Dispensed Instant Tickets

In some jurisdictions, instant tickets from the same deal may be purchased from machines or clerk stations. For example, instant game lottery tickets may be dispensed by clerks who manually retrieve the tickets from a stack, roll or pool of tickets. The present invention may be implemented with a combination of gaming terminals 104 and clerk-assisted purchase/dispensing stations. If so, it may be desirable to use a delayed resetting of a progressive display and/or ticket checkers to thwart potential clerk misconduct, as described in U.S. Pat. No. 10,062,240 (Breslo et al.), which is incorporated by reference herein.

In this embodiment, the "gaming terminal" or "gaming machine" includes the electronic devices used by the clerk during the purchase process, which typically includes at least a scanner that the clerk uses to scan machine-readable indicia on the instant ticket to indicate that an instant ticket is being purchased. The scanner is typically connected to a gateway that reports the ticket purchase to the gaming server 102.

E. Selection of Predetermined Range of Coin-in or Jackpot Values

The predetermined range is preferably selected to minimize the risk of the following scenarios from occurring:

1. Progressive jackpot is sometimes extremely small, compared to its maximum potential value. This scenario may discourage players from participating in future instant games. This scenario can be avoided by selecting a minimum coin-in value that is not an extremely small percentage of the total coin-in value of the deal. This scenario can also be avoided by using a seed value. However, it is not always feasible to seed a progressive jackpot.

2. Progressive jackpot regularly hits only after reaching close to its maximum potential value. This scenario may discourage game play until the progressive jackpot reaches a very high value. This scenario can be avoided by selecting a minimum coin-in value that is not a very high percentage of the total monetary cost of the tickets that are expected to be played in the next predefined time period, such as the next month.

In one preferred embodiment, the predetermined range of coin-in has a minimum value that is no less than 10% of the total monetary cost of the tickets that are expected to be played in the next predefined time period.

Similar considerations exist for selection of predetermined range of values in the jackpot range embodiment of FIG. 4.

F. Selection of Coin-in Value or Progressive Jackpot Value

In one embodiment, the selection of these values occurs prior to game play of any instant tickets from the deal. This embodiment presumes that the progressive jackpot is being funded by all ticket purchases in the deal and that there is only one progressive jackpot per deal. In another embodiment, there are multiple jackpots per deal, as described above in section B, and the selection of these values occurs at the point in time when a new progressive jackpot is established (i.e., each time a new progressive jackpot is established).

G. Selection of Alternative Winning Progressive Jackpot Ticket

To ensure that the progressive jackpot is properly awarded, the second RNG 209 may pick one or more backup ticket numbers as the winning progressive jackpot ticket in the event that the system 100 detects that the selected winning progressive jackpot ticket is not, or cannot, be played. Any number of reasons may occur to cause such a condition, such as a dispenser jam, a dispenser being taken offline, or a problem with the ticket itself. If any such condition is detected, the system 100 will then designate one of the backup ticket numbers as being the winning progressive jackpot ticket, and the originally selected winning progressive jackpot ticket is immediately nullified as being a winning progressive jackpot ticket.

H. Timing of Random Selection of Coin-in Value or Progressive Jackpot Amount Value The random selection of the coin-in value or the progressive jackpot amount value preferably occurs upon initiation of a progressive jackpot (i.e., when the progressive jackpot feature of the system 10 is turned on). This event may occur at the beginning of a deal, or during the deal. If there will only be one progressive jackpot for a deal, the random selection occurs prior to game play of any instant tickets from the deal. When there are multiple progressive jackpots in a deal, the random selection occurs upon initiation of each of the subsequent progressive jackpots.

I. Predetermined Range of Coin-in Values

The lower value in the range should be a non-zero value, and the higher value in the range should be no greater than the total monetary cost of the deal of tickets that are expected to be played in the next predefined time period. For example, if the total monetary cost of the deal of tickets that are expected to be played in the next predefined time period is $20,000,000, this means that the coin-in value will be $20,000,000 if all tickets in the deal are purchased (played) in the next predefined time period. A predetermined range may be set, such as $5,000,000 to $13,000,000, and the RNG 108 then randomly selects a coin-in value within that range, such as $10,352,765.

The total monetary cost of the deal of tickets that are expected to be played in the next predefined time period may be estimated from current ticket volume in the system 10, or may be estimated based on previous sales data.

J. Cross-Deal Progressive Jackpot

In one simple embodiment, there is a single deal, and the one or more progressive jackpots for the single deal are selected using the processes described above, wherein the randomly selected coin-in value will be a value that will be reached while playing the single deal. In a more robust environment, there are a plurality of deals which are continuously activated. As one deal finishes, another deal automatically begins, and so on, all of which is transparent to the players. In this embodiment, the coin-in values that are used for selection of the winning progressive jackpot ticket may span across multiple deals. Consider, for example, a succession of deals, each deal having a total coin-value of $100,000. When a progressive jackpot is initiated, the first half of deal 1 may be completed, and it is expected that deal 2 will begin in 1 week based on projected ticket sales. The pre-programmed range of coin-in values may span across deals 1 and 2, such as $75,000-$125,000. Thus, the randomly selected coin-in value may potentially be reached while playing a ticket in either deal 1 or deal 2.

K. Progressive Jackpot Funding

As discussed above, a progressive jackpot is typically funded by allocating a small percentage of the purchase price of each game play to the jackpot. Accordingly, as more tickets are purchased, the amount of the progressive jackpot increases. However, the funding of the progressive jackpot need not be a perfectly linear process where the progressive jackpot is perfectly aligned with a predetermined percentage of the coin-in. In fact, a progressive jackpot may even be funded only by a percentage of winning tickets. Seed values may also be used to avoid having very low progressive jackpot amounts. The progressive jackpot may also be turned on and off during game play, depending upon operator preferences. Accordingly, while in one embodiment of the present invention, the potential jackpot value may be based on the total monetary cost of the deal of tickets that are expected to be played in the next predefined time period, other embodiments of the present invention do not required any such correlation between the jackpot value and the total monetary cost of the deal of tickets that are expected to be played in the next predefined time period. The scope of the present invention is not limited to any specific progressive jackpot funding mechanism.

Preferred embodiments of the present invention may be implemented as methods, of which examples have been provided. The acts performed as part of the methods may be ordered in any suitable way. Accordingly, embodiments may be constructed in which acts are performed in an order different than illustrated, which may include performing some acts simultaneously, even though such acts are shown as being sequentially performed in illustrative embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. An automated method for selecting a winning progressive jackpot ticket from a deal of instant tickets that are played across a network of gaming machines that dispense instant tickets that are available for purchase, the network of gaming machines being connected to a server that tracks (i) a first progressive jackpot value for the network of gaming machines, and (ii) played and unplayed instant tickets, each of the instant tickets having a unique identification number, the method comprising:

(a) randomly selecting upon initiation of a progressive jackpot, using a first random number generator (RNG), a second progressive jackpot value that falls within a predetermined range of progressive jackpot values, the lower value in the range being a non-zero value;

(b) detecting in the server when the first jackpot value is reached as a result of a jackpot funding contribution from a purchase of an instant ticket at one of the gaming machines;

(c) randomly selecting, using a second RNG, the winning progressive jackpot ticket from all of the unplayed instant tickets, or from the next n number of unplayed instant tickets, when the first jackpot value is detected as reaching the second jackpot value that was randomly selected in step (a); and (d) awarding, by the server, a current progressive jackpot amount to a player who purchases the winning progressive jackpot ticket wherein unplayed instant tickets are instant tickets which have not yet been purchased, and played instant tickets are instant tickets that have been purchased, and wherein the current progressive jackpot amount is the progressive jackpot amount at the time of purchase of the winning progressive jackpot ticket.

2. The method of claim 1 wherein the higher value in the predetermined range of progressive jackpot values is less than the maximum potential jackpot value based on the total monetary cost of the deal of tickets that are expected to be played in a forthcoming predefined time period.

3. The method of claim 1 further comprising:

(e) further awarding, by the server, any winning amounts associated with a non-jackpot game play of the winning progressive jackpot ticket.

4. The method of claim 1 wherein there is one progressive jackpot in the deal of instant tickets, and the random selection of the progressive jackpot value occurs prior to game play of any instant tickets in the deal, and wherein the winning progressive jackpot ticket is randomly selected in step (c) from all of the unplayed instant tickets.

5. The method of claim 1 wherein there are multiple progressive jackpots in the deal of instant tickets, and the random selection of the progressive jackpot value occurs upon initiation of each of the progressive jackpots, and wherein the winning progressive jackpot ticket is randomly selected in step (c) from the next n number of unplayed instant tickets.

6. The method of claim 1 wherein the higher value within the predetermined range of progressive jackpot values is the maximum potential jackpot value based on a total monetary cost of the deal of tickets that are expected to be played in a forthcoming predefined time period.

7. The method of claim 1 wherein the higher value within the predetermined range of progressive jackpot values is the maximum potential jackpot value set by a gaming operator.

8. A gaming system for selecting a winning progressive jackpot ticket from a deal of instant tickets that are played across a network of gaming machines that dispense instant tickets that are available for purchase, the gaming system comprising:

(a) a first random number generator (RNG) configured to randomly select upon initiation of a progressive jackpot, a first progressive jackpot value that falls within a predetermined range of progressive jackpot values, the lower value in the range being a non-zero value;

(b) a server connected to the network of gaming machines, the server being configured to:

(i) track a second progressive jackpot value for the network of gaming machines, (ii) track played and unplayed instant tickets, each of the instant tickets having a unique identification number, and (iii) detect when the second jackpot value is reached as a result of a jackpot funding contribution from a purchase of an instant ticket at one of the gaming machines; and (c) a second RNG configured to randomly select the winning progressive jackpot ticket from all of the unplayed instant tickets, or from the next n number of unplayed instant tickets, when the second jackpot value is detected as reaching the first jackpot value that was randomly selected by the first RNG, and the server being further configured to:

(iv) award a current progressive jackpot amount to a player who purchases the winning progressive jackpot ticket, wherein unplayed instant tickets are instant tickets which have not yet been purchased, and played instant tickets are instant tickets that have been purchased, and wherein the current progressive jackpot amount is the progressive jackpot amount at the time of purchase of the winning progressive jackpot ticket.

9. The gaming system of claim 8 wherein the first RNG and the second RNG are identical to each other.

10. The gaming system of claim 8 wherein the higher value in the predetermined range of progressive jackpot values is less than the maximum potential jackpot value based on a total monetary cost of the deal of tickets that are expected to be played in a forthcoming predefined time period.

11. The gaming system of claim 8 wherein the server is further configured to:

(v) award any winning amounts associated with a non-jackpot game play of the winning progressive jackpot ticket.

12. The gaming system of claim 8 wherein there is one progressive jackpot in the deal of instant tickets, and the random selection of the progressive jackpot value occurs prior to game play of any instant tickets in the deal, and wherein the winning progressive jackpot ticket is randomly selected from all of the unplayed instant tickets.

13. The gaming system of claim 8 wherein there are multiple progressive jackpots in the deal of instant tickets, and the random selection of the progressive jackpot value occurs upon initiation of each of the progressive jackpots, and wherein the winning progressive jackpot ticket is randomly selected from the next n number of unplayed instant tickets.

14. The gaming system of claim 8 wherein the higher value within the predetermined range of progressive jackpot values is the maximum potential jackpot value set by a gaming operator.

* * * * *